US007459062B2

(12) United States Patent
Mayer et al.

(10) Patent No.: US 7,459,062 B2
(45) Date of Patent: Dec. 2, 2008

(54) DRYER SECTION

(75) Inventors: Roland Mayer, Heidenheim (DE); Markus Oechsle, Bartholomae (DE); Antje Stein, Heidenhelm (DE); Frank Wegehaupt, Ulm (DE)

(73) Assignee: Voith Paper Patent GmbH, Heidenheim (DE)

( * ) Notice: Subject to any disclaimer, the term of this patent is extended or adjusted under 35 U.S.C. 154(b) by 467 days.

(21) Appl. No.: 11/040,032

(22) Filed: Jan. 24, 2005

(65) Prior Publication Data

US 2005/0138837 A1 Jun. 30, 2005

Related U.S. Application Data

(63) Continuation of application No. PCT/EP2003/050291, filed on Jul. 8, 2003.

(30) Foreign Application Priority Data

Jul. 25, 2002 (DE) ..... 102 33 795

(51) Int. Cl.
*D21F 5/08* (2006.01)
*D21F 5/02* (2006.01)

(52) U.S. Cl. ..... 162/375; 162/197; 162/207; 162/271; 162/DIG. 6; 34/113; 34/348; 34/446

(58) Field of Classification Search ..... 162/123, 162/135–137, 187, 207, 208, 197, 270, 271, 162/275, DIG. 6; 34/611, 618, 623, 113, 34/116, 117, 123, 446, 348
See application file for complete search history.

(56) References Cited

U.S. PATENT DOCUMENTS 4,474,643 A * 10/1984 Lindblad ..... 162/198
5,065,673 A 11/1991 Taylor et al.
5,416,980 A * 5/1995 Ilvespaa ..... 34/117
5,557,860 A * 9/1996 Kotitschke et al. ..... 34/455
5,592,751 A * 1/1997 Guggemos et al. ..... 34/117
5,632,101 A * 5/1997 Oechsle ..... 34/445
5,771,603 A 6/1998 Kotitscke et al.
6,001,421 A * 12/1999 Ahonen et al. ..... 427/316
6,251,223 B1 * 6/2001 Kessler et al. ..... 162/125
6,401,355 B1 6/2002 Linnonmaa et al.
6,440,271 B1 8/2002 Heikkinen et al.
6,490,813 B1 * 12/2002 Oechsle ..... 34/445

(Continued)

FOREIGN PATENT DOCUMENTS

DE 9414963 12/1994

(Continued)

*Primary Examiner*—Eric Hug
(74) *Attorney, Agent, or Firm*—Greenblum & Bernstein, P.L.C.

(57) ABSTRACT

Dryer section for drying a fibrous web supported by at least one drying fabric. The dryer section includes a plurality of heated drying cylinders, a plurality of guide rolls, and a plurality of dampening devices arranged at different locations relative to the fibrous web. Each dampening device applies a quantity of liquid to the fibrous web. In at least in one of the plurality of dampening devices, the quantity of the liquid is adjustable separately in zones transversely with respect to a web running direction. This Abstract is not intended to define the invention disclosed in the specification, nor intended to limit the scope of the invention in any way.

37 Claims, 1 Drawing Sheet

U.S. PATENT DOCUMENTS

| | | | | |
|---|---|---|---|---|
| 6,494,988 | B1 | 12/2002 | Cedra et al. | |
| 6,569,288 | B1 | 5/2003 | Linnonmaa et al. | |
| 6,699,365 | B2 * | 3/2004 | Duan | 162/207 |
| 7,249,424 | B2 * | 7/2007 | Lipponen et al. | 34/446 |

FOREIGN PATENT DOCUMENTS

| | | | |
|---|---|---|---|
| DE | 69431005 | | 2/2003 |
| EP | 0915201 | | 5/1999 |
| EP | 1050622 | | 8/2000 |
| EP | 1199404 | | 4/2002 |
| WO | 00/03087 | | 1/2000 |
| WO | WO 00/03087 | * | 1/2000 |

* cited by examiner

DRYER SECTION

CROSS-REFERENCE TO RELATED APPLICATIONS

The instant application is a continuation of International Application No. PCT/EP2003/050291 filed on Jul. 8, 2003 and published as International Publication WO 2004/011722 on Feb. 5, 2004, the disclosure of which is hereby expressly incorporated by reference hereto in its entirety. The instant application also claims priority under 35 U.S.C. §119 of German Application No. 102 33 795.0 filed on Jul. 25, 2002.

BACKGROUND OF THE INVENTION

1. Field of the Invention

The invention relates to a dryer section for drying a paper, board, tissue or another fibrous web in a machine for producing and/or finishing the fibrous web, in which the fibrous web, supported by at least one drying fabric, is led over a plurality of heated drying cylinders and guide rolls.

2. Discussion of Background Information

Dryer sections of this type have been in use for a long time in a variety of forms. Stresses are often built up in the fibrous web, which lead to an increased tendency to curl. In addition, the cross-machine moisture profile of the fibrous web is generally not satisfactory, since overdrying occurs, in particular, at the edges.

Hitherto, this has been countered with mutually separated apparatuses, a nozzle dampener for influencing the moisture profile, normally in the dryer section, and a steam dampener for influencing the tendency to curl, generally arranged after the dryer section.

SUMMARY OF THE INVENTION

The invention aims to improve the cross-machine moisture profile and the tendency of the fibrous web to curl, by using a simple arrangement.

According to the invention, a plurality of dampening devices, preferably two dampening devices, are arranged within the dryer section at different positions opposite the fibrous web. The quantity of liquid applied to the fibrous web, at least in one dampening device, is made adjustable separately in zones transversely with respect to the web running direction.

The use of a plurality of dampening devices, firstly, permits an influence to be exerted repeatedly during the drying process on the cross-machine moisture profile, the flatness and, possibly, also the tendency to curl and, secondly, on at least individual parameters of the fibrous web, such as the cross-machine moisture profile or the tendency to curl, separately via at least one dampening device.

Here, it has been recognized that the parameters may be changed relatively simply during the drying process, independently influencing the parameters expands the correction spectrum substantially, and exerting a repeated influence on a parameter leads to improved results.

For the purpose of simplification, at least one, preferably all, the dampening devices has/have nozzles arranged beside one another transversely with respect to the web running direction. It is advantageous here, if the nozzles are at least partly formed as pneumatic atomizer nozzles.

Depending on the type, the moisture content, and the parameter of the fibrous web to be influenced, it is advantageous if the dampening devices overall apply different quantities of liquid to the fibrous web.

Depending on the quantity of liquid to be applied, the moisture content, and the type of fibrous web, it is likewise advantageous if the dampening devices discharge the liquid with different droplet sizes, whereby the mean droplet diameter remains below a limiting value which preferably does not exceed 100 μm according to Sauter.

In coordination with the quantity of liquid to be applied, the droplet size and the type of parameter to be influenced, the dampening devices should in turn have different nozzle types and/or various spray angles with respect to the fibrous web.

The number of zones of a dampening device should be chosen in accordance with the parameter to be influenced. In particular, in order to influence the tendency to curl, one or a few zones are sufficient.

In order to match the characteristic requirements of the fibrous web, it is advantageous if the zones of the dampening devices have different widths.

The cross-machine moisture profiles to be expected depend on the type of dryer section, in addition to the type of fibrous web, that is to say the grammage, the thickness, and the width.

In order to limit the number of zones for reasons of cost, the subdivision of the zones can therefore been chosen in accordance with the cross-machine moisture profile to be expected and/or the necessary correction of the tendency to curl.

In particular, if the dampening devices influence various parameters, the number of zones should be restricted to the extent respectively needed for this purpose. As a result, the dampening devices have a different number of zones.

For a few-zone dampening device, for example, for influencing the tendency of the fibrous web to curl, between 1 and 25 zones are often already sufficient.

As opposed to this, the many-zone dampening devices have zones with a width between 20 mm and 150 mm, preferably between 20 mm and 50 mm.

In order to utilize the maximum possible sprayed quantity for cross-machine moisture profile correction, the first dampening device in the web running direction should be arranged in a region of the dryer section in which the dryness of the fibrous web is at least 60%, but lies at least 2% below the dryness which the fibrous web has at the end of the dryer section.

On the other hand, in order to be able to influence the tendency to curl sufficiently, the last dampening device in the web running direction should be arranged in a region of the dryer section in which the dryness of the fibrous web is at least 80%.

Because of the increased tendency of the fibrous web to curl, the use of the dampening devices is advantageous in drying groups of the dryer section in which only one side of the fibrous web comes into contact with the drying cylinders.

Particularly suitable is the arrangement of the dampening devices in dryer sections in which the fibrous web is led between the drying cylinders of a drying group of the dryer section over evacuated guide rolls. The drying fabric can be located between guide roll and fibrous web. In this case, at least one, preferably all, of the dampening devices should be arranged in the region of an evacuated guide roll.

In connection with the required drynesses of the fibrous web, it is frequently advantageous if the last dampening device in the web running direction is arranged in the region of the last evacuated guide roll of the dryer section, and the first dampening device, in the web running direction, is arranged in the region of the last evacuated guide roll of the penultimate drying group of the dryer section.

To ensure the necessary correction accuracy, it is advantageous if the first dampening device in the web running direction is used substantially, preferably exclusively, for correcting the cross-machine moisture profile of the fibrous web and is adjusted appropriately.

This in turn makes it possible for the last dampening device in the web running direction to be used substantially, preferably exclusively, for correcting the tendency of the fibrous web to curl and to be set appropriately. Because of the improved possible corrections in this region of the dryer section, in particular, with respect to the cross-machine moisture profile, the first dampening device in the web running direction should have more zones than the last dampening device.

However, it is also possible for the last dampening device in the web running election to be used for correcting the cross-machine moisture profile and the tendency of the fibrous web to curl and to be set appropriately. In particular in this case, the last dampening device in the web running direction should have more zones than the first dampening device, in order better to influence the parameters of the fibrous web.

It is particularly suitable to use the dampening devices in dryer sections which lead to an increased tendency of the fibrous web to curl. These include dryer sections in which, in all the drying groups, in each case only one side of the fibrous web comes into contact with the drying cylinders, and dryer sections in which, in the preferably one or two last drying groups of the dryer section, both sides and therefore at least predominantly only one side of the fibrous web in each case comes into contact with the drying cylinders. In addition, the arrangement of the dampening devices in such dryer sections is also relatively unproblematic.

The use of the dampening devices is, however, also advantageous in multilayer fibrous webs or fibrous webs which are treated on one side with substances that influence the surface properties.

The invention also provides for a dryer section for drying a fibrous web supported by at least one drying fabric, wherein the dryer section comprises a plurality of heated drying cylinders, a plurality of guide rolls, a plurality of dampening devices arranged at different locations relative to the fibrous web, and each dampening device applying a quantity of liquid to the fibrous web, wherein, in at least in one of the plurality of dampening devices, the quantity of the liquid is adjustable separately in zones transversely with respect to a web running direction.

The fibrous web may comprise one of a paper web, a board web and a tissue web and the dryer section may be arranged in a machine for producing and/or finishing the fibrous web. The plurality of dampening devices may constitute two dampening devices.

The dryer section may further comprise one of at least one of the plurality of dampening devices comprising a plurality of nozzles arranged beside one another transversely with respect to the web running direction and each of the plurality of dampening devices comprising a plurality of nozzles arranged beside one another transversely with respect to the web running direction.

The dryer section may further comprise one of at least one of the plurality of nozzles comprises a pneumatic atomizer nozzle and each of the plurality of nozzles comprises a pneumatic atomizer nozzle. The plurality of dampening devices may apply different quantities of liquid to the fibrous web.

The dryer section may further comprise at least one of the liquid is applied as droplets having various mean droplet diameters and the liquid is applied as droplets having a mean droplet diameter according to Sauter not exceeding 100 μm.

The dryer section may further comprise at least one of at least one of the plurality of dampening devices utilizing different nozzle types and at least one of the plurality of dampening devices utilizing nozzles with various spray angles. The plurality of the dampening devices may apply liquid to zones of the fibrous web having different widths. The plurality of dampening devices may comprise first and second dampening devices wherein the first and second dampening devices apply liquid to a different number of zones of the fibrous web.

The plurality of dampening devices may comprise first and second dampening devices, wherein the first dampening device applies liquid to less zones of the fibrous web than the second dampening device, and wherein the first dampening device has between 1 and 25 zones.

The dryer section may further comprise one of the second dampening device has zones with a width between 20 mm and 150 mm and the second dampening device has zones with a width between 20 mm and 50 mm.

The plurality of dampening devices may comprise first and second dampening devices, wherein the first dampening device is arranged before the second dampening device relative to a web running direction, and wherein the first dampening device is arranged in a region of the dryer section in which the fibrous web has a dryness of at least 60%. The first dampening device may be arranged in a region of the dryer section in which the fibrous web has a dryness of at least 2% below a dryness of the fibrous web at an end of the dryer section.

The plurality of dampening devices may comprise first and second dampening devices, wherein the first dampening device is arranged before the second dampening device relative to a web running direction, and wherein the second dampening device is arranged in a region of the dryer section in which the fibrous web has a dryness of at least 80%.

The dryer section may comprise drying groups and wherein only one side of the fibrous web comes into contact with the plurality of guide rolls. The guide rolls of at least one of the drying groups may comprise evacuated guide rolls and wherein the at least one drying fabric guides the fibrous web around the evacuated guide rolls such that the at least one drying fabric is arranged between the evacuated guide rolls and the fibrous web.

At least one of the plurality of dampening devices may be arranged in a region of an evacuated guide roll. A last one of the plurality of dampening devices may be arranged in a region of a last one of the evacuated guide rolls. A first one of the plurality of dampening devices may be arranged in a region of a last evacuated guide roll of a penultimate drying group.

A first one of the plurality of dampening devices may be at least one of configured to substantially correct a cross-machine moisture profile of the fibrous web, adjusted to substantially correct a cross-machine moisture profile of the fibrous web, configured to exclusively correct a cross-machine moisture profile of the fibrous web, and adjusted to exclusively correct a cross-machine moisture profile of the fibrous web.

A least one of the plurality of dampening devices may be at least one of configured to substantially correct a tendency of the fibrous web to curl, adjusted to substantially correct a tendency of the fibrous web to curl, configured to exclusively correct a tendency of the fibrous web to curl, and adjusted to exclusively correct a tendency of the fibrous web to curl.

A first one of the plurality of dampening devices may have more zones than a last one of the plurality of dampening devices. The last one of the plurality of dampening devices may be one of configured to correct a cross-machine moisture profile of the fibrous web and a tendency of the fibrous web to curl and adjusted to correct a cross-machine moisture profile of the fibrous web and a tendency of the fibrous web to curl.

A last one of the plurality of dampening devices may have more zones than a first one of the plurality of dampening devices. The dryer section may comprise a plurality of drying groups and wherein only one side of the fibrous web comes into contact with the plurality of heated drying cylinders of all of the drying groups. The dryer section may comprise a plurality of drying groups, wherein only one side of the fibrous web contacts the plurality of heated drying cylinders of all of the drying groups except for the last drying group, and wherein both sides of the fibrous web contacts the heated drying cylinders of the last drying group.

The dryer section may comprise a plurality of drying groups, wherein only one side of the fibrous web contacts the plurality of heated drying cylinders of all of the drying groups except for the last two drying groups, and wherein both sides of the fibrous web contact with the plurality of heated drying cylinders of the last two drying groups.

The invention also provides for a method treating a fibrous web using a dryer section for drying a fibrous web supported by at least one drying fabric and comprising a plurality of heated drying cylinders, a plurality of guide rolls, a plurality of dampening devices arranged at different locations relative to the fibrous web, and each dampening device applying a quantity of substances to the fibrous web wherein, in at least in one of the plurality of dampening devices, the quantity of the substances is adjustable separately in zones transversely with respect to a web running direction, wherein the method comprises applying the substances to one side of the fibrous web in order to influence surface properties of the fibrous web.

The fibrous web may comprise a multiplayer fibrous web.

The invention also provides for a dryer section for drying a fibrous web supported by at least one drying fabric, wherein the dryer section comprises a plurality of drying groups each comprising a plurality of heated drying cylinders and a plurality of guide rolls, a first dampening device applying a quantity of liquid to the fibrous web in a region of one of the plurality of guide rolls, and a second dampening device applying a quantity of liquid to the fibrous web in a region of another of the plurality of guide rolls, wherein, in at least in one of the first and second dampening devices, the quantity of the liquid is adjustable separately in zones transversely with respect to a web running direction.

BRIEF DESCRIPTION OF THE DRAWINGS

The invention will be explained in more detail in the following text by using two exemplary embodiments and with reference to the drawings, wherein.

DETAILED DESCRIPTION OF THE PRESENT INVENTION

Figure 1:
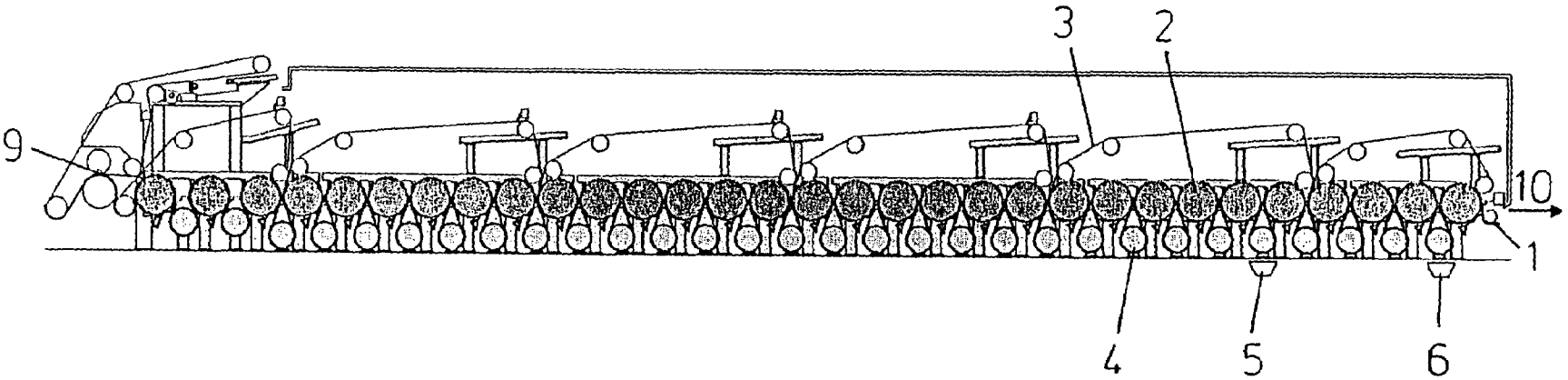
FIG. 1 shows a dryer section having single-row drying groups.

In both cases, the fibrous web 1 runs jointly with a press felt through a press nip 9 formed by two press rolls for the purpose of dewatering. The fibrous web 1 then arrives in the dryer section. There, the fibrous web 1 is heated and dried by the direct contact with heated drying cylinders 2.

The dryer sections comprise a plurality of drying groups, each drying group being formed by one or two rows of drying cylinders 2 arranged one above another. In this case, each row of drying cylinders 2 is in each case assigned a drying fabric 3 for supporting the fibrous web 1.

At least in the first part of the dryer section, the drying is carried out on one side, since here the underside of the fibrous web 1 comes into contact with the drying cylinders 2 arranged in a row. Between the drying cylinders 2, the fibrous web 1, together with the corresponding drying fabric 3, in each case wraps around an evacuated guide roll 4, the drying fabric 3 being located between guide roll 4 and fibrous web 1.

The evacuated guide rolls 4 have a perforated roll cover, whose interior is connected to a vacuum source. The vacuum ensures that the fibrous web 1 is sucked toward the drying fabric 3 as it wraps around the guide roll 4.

These drying groups are constructed relatively simply and permit unproblematic discharge of broke into the machine basement. Because of the one-sided drying, however, the tendency of the fibrous web 1 to curl is particularly highly pronounced.

Therefore, in the dryer section there are two dampening devices 5, 6 in the form of nozzle dampeners running transversely with respect to the web running direction 10, which have a plurality of pneumatic atomizer nozzles arranged beside one another transversely with respect to the web running direction 10. These dampening devices 5, 6 are arranged opposite the fibrous web 1 and, with respect to the quantity of liquid applied to the fibrous web 1, can be controlled separately in zones transversely with respect to the web running direction 10.

In FIG. 1, all the drying groups each comprise only one row of drying cylinders 2, only the underside of the fibrous web 1 coming into contact with these. In order to correct the cross-machine moisture profile of the fibrous web 1, there is a dampening device 5 in the wrap region of the last evacuated guide roll 4 of the penultimate drying group. In this region, the fibrous web 1 already has a dryness of more than 60%, and therefore also sufficient strength, which permits dampening. In order to be able to exert the most accurate influence on the cross-machine moisture profile, this dampening device 5 has a relatively large number of narrow zones with a width between 20 mm and 50 mm.

The level of the dampening originating from the zones is adjusted in the form of control as a function of the measured cross-machine moisture profile of the fibrous web 1.

In order to influence the tendency to curl, the last evacuated guide roll 4 is assigned a second dampening device 6. This has only one zone. The dryness of the fibrous web is more than 80% in this case.

Figure 2:
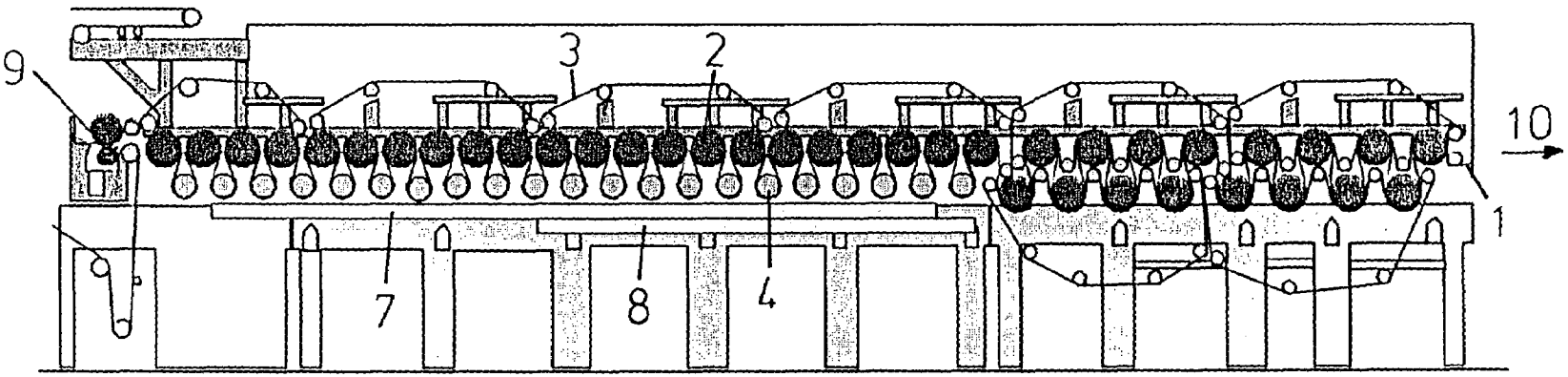
FIG. 2 shows a dryer section having a two-row final group.

In the dryer section shown in FIG. 2, the first four drying groups in each case comprise a row of drying cylinders 2, and the last two drying groups each comprise two rows arranged one above another.

In this case, in the central region 7 of the single-row part of the dryer section, the arrangement of a first dampening device 5 in the web running direction 10 in the wrap region of an evacuated guide roll 4 is possible, since there is a sufficiently high dryness of more than 60% there. Here, too, this dampening device 5 is used for correcting the cross-machine moisture profile of the fibrous web 1.

In the end region 8 of the single-row part of the dryer section, a second dampening device 6 can be fitted opposite an evacuated guide roll 4. Here, the dryness of the fibrous web 1 is more than 80%. This dampening device 6 is used for correcting the cross-machine moisture profile and for influencing the tendency of the fibrous web 1 to curl and therefore has more zones than the first dampening device 5.

In general, water is used for dampening; the droplet size and the spray angle with respect to the fibrous web 1 should be matched to the conditions.

What is claimed:

1. A dryer section for drying a fibrous web supported by at least one drying fabric, the dryer section comprising:

a plurality of heated drying cylinders;

a plurality of guide rolls;

a plurality of dampening devices arranged at different locations relative to the fibrous web;

at least one of the guide rolls being an evacuated guide roll;

one of the dampening devices being arranged in a region of the evacuated guide roll; and each dampening device applying a quantity of liquid to the fibrous web, wherein, in at least in one of the plurality of dampening devices, the quantity of the liquid is adjustable separately in zones transversely with respect to a web running direction, and wherein a first one of the plurality of dampening devices has more zones than a second one of the plurality of dampening devices.

2. The dryer section of claim 1, wherein the fibrous web comprises one of a paper web, a board web and a tissue web and wherein the dryer section is arranged in a machine for producing and/or finishing the fibrous web.

3. The dryer section of claim 1, wherein the plurality of dampening devices constitutes two dampening devices.

4. The dryer section of claim 1, further comprising one of:

at least one of the plurality of dampening devices comprising a plurality of nozzles arranged beside one another transversely with respect to the web running direction; and each of the plurality of dampening devices comprising a plurality of nozzles arranged beside one another transversely with respect to the web running direction.

5. The dryer section of claim 4, further comprising one of:

at least one of the plurality of nozzles comprises a pneumatic atomizer nozzle; and each of the plurality of nozzles comprises a pneumatic atomizer nozzle.

6. The dryer section of claim 1, wherein the plurality of dampening devices apply different quantities of liquid to the fibrous web.

7. The dryer section of claim 1, further comprising at least one of:

the liquid is applied as droplets having various mean droplet diameters; and the liquid is applied as droplets having a mean droplet diameter according to Sauter not exceeding 100 μm.

8. The dryer section of claim 1, further comprising at least one of:

at least one of the plurality of dampening devices utilizing different nozzle types; and at least one of the plurality of dampening devices utilizing nozzles with various spray angles.

9. The dryer section of claim 1, wherein the plurality of the dampening devices apply liquid to zones of the fibrous web having different widths.

10. The dryer section of claim 1, wherein the first and second dampening devices apply liquid to a different number of zones of the fibrous web.

11. The dryer section of claim 1, wherein the first dampening device applies liquid to less zones of the fibrous web than the second dampening device, and wherein the first dampening device has between 1 and 25 zones.

12. The dryer section of claim 11, further comprising one of:

the second dampening device has zones with a width between 20 mm and 150 mm; and the second dampening device has zones with a width between 20 mm and 50 mm.

13. The dryer section of claim 1, wherein the first dampening device is arranged before the second dampening device relative to a web running direction, and wherein the first dampening device is arranged in a region of the dryer section in which the fibrous web has a dryness of at least 60%.

14. The dryer section of claim 13, wherein the first dampening device is arranged in a region of the dryer section in which the fibrous web has a dryness of at least 2% below a dryness of the fibrous web at an end of the dryer section.

15. The dryer section of claim 1, wherein the first dampening device is arranged before the second dampening device relative to a web running direction, and wherein the second dampening device is arranged in a region of the dryer section in which the fibrous web has a dryness of at least 80%.

16. The dryer section of claim 1, wherein the dryer section comprises drying groups and wherein only one side of the fibrous web comes into contact with the plurality of guide rolls.

17. The dryer section of claim 16, wherein the guide rolls of at least one of the drying groups comprise evacuated guide rolls and wherein the at least one drying fabric guides the fibrous web around the evacuated guide rolls such that the at least one drying fabric is arranged between the evacuated guide rolls and the fibrous web.

18. The dryer section of claim 17, wherein the second dampening device comprises a last one of the plurality of dampening devices and is arranged in a region of a last one of the evacuated guide rolls.

19. The dryer section of claim 17, wherein the first one of the plurality of dampening devices is arranged in a region of a last evacuated guide roll of a penultimate drying group.

20. The dryer section of claim 1, wherein the first one of the plurality of dampening devices is at least one of:

configured to substantially correct a cross-machine moisture profile of the fibrous web;

adjusted to substantially correct a cross-machine moisture profile of the fibrous web;

configured to exclusively correct a cross-machine moisture profile of the fibrous web; and adjusted to exclusively correct a cross-machine moisture profile of the fibrous web.

21. The dryer section of claim 1, wherein a last one of the plurality of dampening devices is at least one of:

configured to substantially correct a tendency of the fibrous web to curl;

adjusted to substantially correct a tendency of the fibrous web to curl;

configured to exclusively correct a tendency of the fibrous web to curl; and adjusted to exclusively correct a tendency of the fibrous web to curl.

22. The dryer section of claim 1, wherein the second dampening device comprises a last one of the plurality of dampening devices.

23. The dryer section of claim 22, wherein the last one of the plurality of dampening devices is one of:

configured to correct a cross-machine moisture profile of the fibrous web and a tendency of the fibrous web to curl; and adjusted to correct a cross-machine moisture profile of the fibrous web and a tendency of the fibrous web to curl.

24. The dryer section of claim 1, wherein the dryer section comprises a plurality of drying groups and wherein only one side of the fibrous web comes into contact with the plurality of heated drying cylinders of all of the drying groups.

25. The dryer section of claim 1, wherein the dryer section comprises a plurality of drying groups, wherein only one side of the fibrous web contacts the plurality of heated drying cylinders of all of the drying groups except for the last drying group, and wherein both sides of the fibrous web contacts the heated drying cylinders of the last drying group.

26. The dryer section of claim 1, wherein the dryer section comprises a plurality of drying groups, wherein only one side of the fibrous web contacts the plurality of heated drying cylinders of all of the drying groups except for the last two drying groups, and wherein both sides of the fibrous web contact with the plurality of heated drying cylinders of the last two drying groups.

27. The dryer section of claim 1, wherein the plurality of heated drying cylinders are arranged above the plurality of guide rolls.

28. The dryer section of claim 27, wherein the plurality of dampening devices are arranged below the plurality of guide rolls.

29. The dryer section of claim 1, wherein two of the plurality of the dampening devices are arranged in a part of the dryer section which has only a single row of the heated drying cylinders.

30. The dryer section of claim 29, wherein the first of the plurality of dampening devices is arranged in a penultimate drying group.

31. The dryer section of claim 29, wherein the second of the plurality of dampening devices is arranged in a region of a last evacuated guide roll of the dryer section.

32. The dryer section of claim 29, wherein the part of the dryer section comprises four drying groups.

33. A method treating a fibrous web using a dryer section for drying a fibrous web supported by at least one drying fabric and comprising a plurality of heated drying cylinders, a plurality of guide rolls, a plurality of dampening devices arranged at different locations relative to the fibrous web, at least one of the guide rolls being an evacuated guide roll, one of the dampening devices being arranged in a region of the evacuated guide roll, and each dampening device applying a quantity of substances to the fibrous web wherein, in at least in one of the plurality of dampening devices, the quantity of the substances is adjustable separately in zones transversely with respect to a web running direction, the method comprising:

applying the substances to one side of the fibrous web in order to influence surface properties of the fibrous web, wherein a first one of the plurality of dampening devices has more zones than a second one of the plurality of dampening devices.

34. The method of claim 33, wherein the fibrous web comprises a multilayer fibrous web.

35. A dryer section for drying a fibrous web supported by at least one drying fabric, the dryer section comprising:

a plurality of drying groups each comprising a plurality of heated drying cylinders and a plurality of guide rolls;

the plurality of guide rolls comprising first and second evacuated guide rolls;

a first dampening device applying a quantity of liquid to the fibrous web in a region of the first evacuated guide roll; and a second dampening device applying a quantity of liquid to the fibrous web in a region of the second evacuated guide roll, wherein, in at least in one of the first and second dampening devices, the quantity of the liquid is adjustable separately in zones transversely with respect to a web running direction, and wherein the first dampening device has more zones than the second dampening device.

36. A dryer section for drying a fibrous web supported by at least one drying fabric, the dryer section comprising:

a plurality of heated drying cylinders;

a plurality of guide rolls;

a plurality of dampening devices arranged at different locations relative to the fibrous web;

at least one of the guide rolls being an evacuated guide roll;

one of the dampening devices being arranged in a wrap region of the evacuated guide roll; and each dampening device applying a quantity of liquid to the fibrous web, wherein, in at least in one of the plurality of dampening devices, the quantity of the liquid is adjustable separately in zones transversely with respect to a web running direction, wherein a last one of the plurality of dampening devices is at least one of:

configured to substantially correct a tendency of the fibrous web to curl;

adjusted to substantially correct a tendency of the fibrous web to curl;

configured to exclusively correct a tendency of the fibrous web to curl; and adjusted to exclusively correct a tendency of the fibrous web to curl, and wherein a first of the dampening devices is arranged in an area of the dryer section wherein the web has a dryness of at least 60%.

37. A dryer section for drying a fibrous web supported by at least one drying fabric, the dryer section comprising:

a plurality of heated drying cylinders;

a plurality of guide rolls;

a plurality of dampening devices arranged at different locations relative to the fibrous web;

at least one of the guide rolls being an evacuated guide roll;

one of the dampening devices being arranged in a wrap region of the evacuated guide roll; and each dampening device applying a quantity of liquid to the fibrous web, wherein, in at least in one of the plurality of dampening devices, the quantity of the liquid is adjustable separately in zones transversely with respect to a web running direction, and wherein a last one of the plurality of dampening devices is at least one of:

configured to substantially correct a tendency of the fibrous web to curl;

adjusted to substantially correct a tendency of the fibrous web to curl;

configured to exclusively correct a tendency of the fibrous web to curl; and adjusted to exclusively correct a tendency of the fibrous web to curl, wherein a first one of the plurality of dampening devices has more zones than a last one of the plurality of dampening devices.

* * * * *